US006142767A

United States Patent [19]

Chan

[11] Patent Number: 6,142,767

[45] Date of Patent: Nov. 7, 2000

[54] CHILDPROOF CIGARETTE LIGHTER

[75] Inventor: Leung Chan, New Territories, The Hong Kong Special Administrative Region of the People's Republic of China

[73] Assignee: Cli-Claque Co., Ltd., The Hong Kong Special Administrative Region of the People's Republic of China

[21] Appl. No.: 09/218,174

[22] Filed: Dec. 22, 1998

[51] Int. Cl.[7] ..... F23D 11/36; F23Q 7/12

[52] U.S. Cl. ..... 431/153; 431/255; 431/277

[58] Field of Search ..... 431/132, 153, 431/255, 277; 222/402.11, 153.11; 251/151, 152

[56] References Cited

U.S. PATENT DOCUMENTS

| | | | |
|---|---|---|---|
| 4,418,842 | 12/1983 | Di Loreto | 222/153.11 |
| 4,454,966 | 6/1984 | Hicks | 222/153.11 |
| 4,832,596 | 5/1989 | Morris, Sr. | 431/153 |
| 5,435,719 | 7/1995 | McDonough et al. | 431/153 |
| 5,458,482 | 10/1995 | Saito et al. | 431/153 |
| 5,558,514 | 9/1996 | Ansquer | 431/153 |
| 5,628,627 | 5/1997 | Fairbanks et al. | 431/153 |
| 5,662,466 | 9/1997 | Cheng | 431/153 |
| 5,829,963 | 11/1998 | Ichikawa | 431/153 |

*Primary Examiner*—Ira S. Lazarus
*Assistant Examiner*—David Lee
*Attorney, Agent, or Firm*—Hall, Priddy, Myers & Vande Sande

[57] ABSTRACT

A cigarette lighter is disclosed. It operates by acting on a push button which opens a valve to release gas from a tank and activate a sparking means for igniting the released gas. The lighter has a "self-retrieving" safety mechanism which is simple and easy for an adult to operate and which can reliably prevent unintentional operation of the lighter, such as by a child. The safety mechanism has an elongated resilient bar provided at one end with an operating member located. The safety mechanism has a normal position in which the safety device prevents operation of the push button and an operating position, to which the safety device can be moved by an operating member in a one step motion, in which the push button can be operated. Upon operation, the safety device automatically returns to its normal position.

7 Claims, 4 Drawing Sheets

CHILDPROOF CIGARETTE LIGHTER

The present invention relates to a cigarette lighter, and in particular to a cigarette lighter with a safety-mechanism whereby accidental operation of the lighter, particularly by a young child, is prevented.

BACKGROUND TO THE INVENTION

Re-fillable lighters are known and their operation involves a straightforward push button action to open a valve, release gas from a tank and ignite the gas by means of a spark. Also known from U.S. Pat. No. 5,538,417 is an ultra-thin cigarette lighter with a self retrieving safety mechanism which is simple and easy for an adult to operate and which can reliably prevent unintentional use of the lighter. Such a cigarette lighter operates by acting on a push button which opens a valve to release gas from a tank and activates a sparking means for igniting the released gas. The lighter has a "self-retrieving" safety mechanism which is simple and easy for an adult to operate and which can reliably prevent unintentional operation of the lighter, such as by a child. The safety mechanism is in the form of an elongated resilient bar provided at one end with an operating member located in a first short portion of a slot in the push button. Said safety mechanism has a normal position in which the safety device prevents operation of the push button by engaging an end portion of said first slot portion, and an operating position, to which the safety device can be moved by means of the operating member into a second slot portion in said push button of a longer length than said first slot portion and in which the push button can be operated, the safety device automatically returning to its normal position after use of the cigarette lighter.

The operation of the cigarette lighter of U.S. Pat. No. 5,538,41 is a two-step process.

BRIEF SUMMARY OF THE INVENTION

It is an object of the present invention to provide a cigarette lighter with a self-retrieving safety mechanism which can be operated by a one-step process and is thus simpler and easier for an adult user to operate than known devices, but which can reliably prevent unintentional use of the lighter, by a child.

It is also an object of the present invention that the said safety mechanism can be used in both conventional and ultra thin cigarette lighters.

In accordance with the invention there is provided a cigarette lighter comprising a tank for a combustible gas under pressure. The lighter also includes a valve which is normally closed to prevent gas from exiting the tank, but which can be opened to allow gas to escape from the tank through a nozzle. Moreover, there is a valve actuator operable to open the valve. A spark producer is also provided that is operable to produce a spark in the vicinity of the nozzle and cause ignition of gas escaping from the tank when the valve is opened by the valve actuator. Another feature of this lighter is a spark producer holder having an upstanding extension with an end. There is also a push button operable by engagement of a user's finger to operate the valve actuator, open the valve and operate said spark producer. Another feature of the lighter is a movable safety device in the form of an elongated resilient bar provided at one end with a rotatable operating member and at the other end with an extension. This safety device is movable between a normal position in which the safety device prevents operation of the push button by means of the extension engaging the end of the upstanding extension of the spark producer holder, and an operating position to which the safety device can be moved by rotation of the operating member about an axis which is substantially parallel to the length of the safety device. By these means the extension of the safety device is moved out of engagement with the end of the upstanding extension of the spark producer holder simultaneously as the push button is pushed inwards so that the extension moves down the side of the upstanding extension, returning to its normal position after use of the cigarette lighter.

BRIEF DESCRIPTION OF THE DRAWINGS

The present invention will be described, by way of example, with reference to the accompanying drawings in which:

As shown in FIG. 1, the cigarette lighter of the present invention comprises a gas tank 14, a body 15 united to the tank 14 by ultra-sonic welding and a windshield 8 mounted on the body 15. The cigarette lighter is provided with a flame control means 12 and an operating push button 4 which has mounted on it an operating member 1 having a boss 1*a*.

In FIG. 2, the cigarette lighter is shown with the operating member 1 in its normal, non-operating position. A locking member 2 provided fixedly secured in operating member recess 16, is with an extension 2*a* (also visible in FIGS. 3 and 4) is connected to the operating member 1 and is arranged within recess 4*a* of the push button 4. A return spring 3 biases the operating member 1 towards its non-operating position. Also illustrated in FIG. 2 is a piezo unit 6. One of its ends is mounted in the push button 4 and it also has an electrode 7 which is mounted in a piezo holder 5 having an upstanding extension 5*a* (best seen in FIGS. 3 and 4). The extension 2*a* of the locking member 2 is normally engaged with the end of the upstanding extension 5*a* of the piezo holder 5 and so obstructs the movement of push button 4 towards the piezo holder 5.

Figure 1:
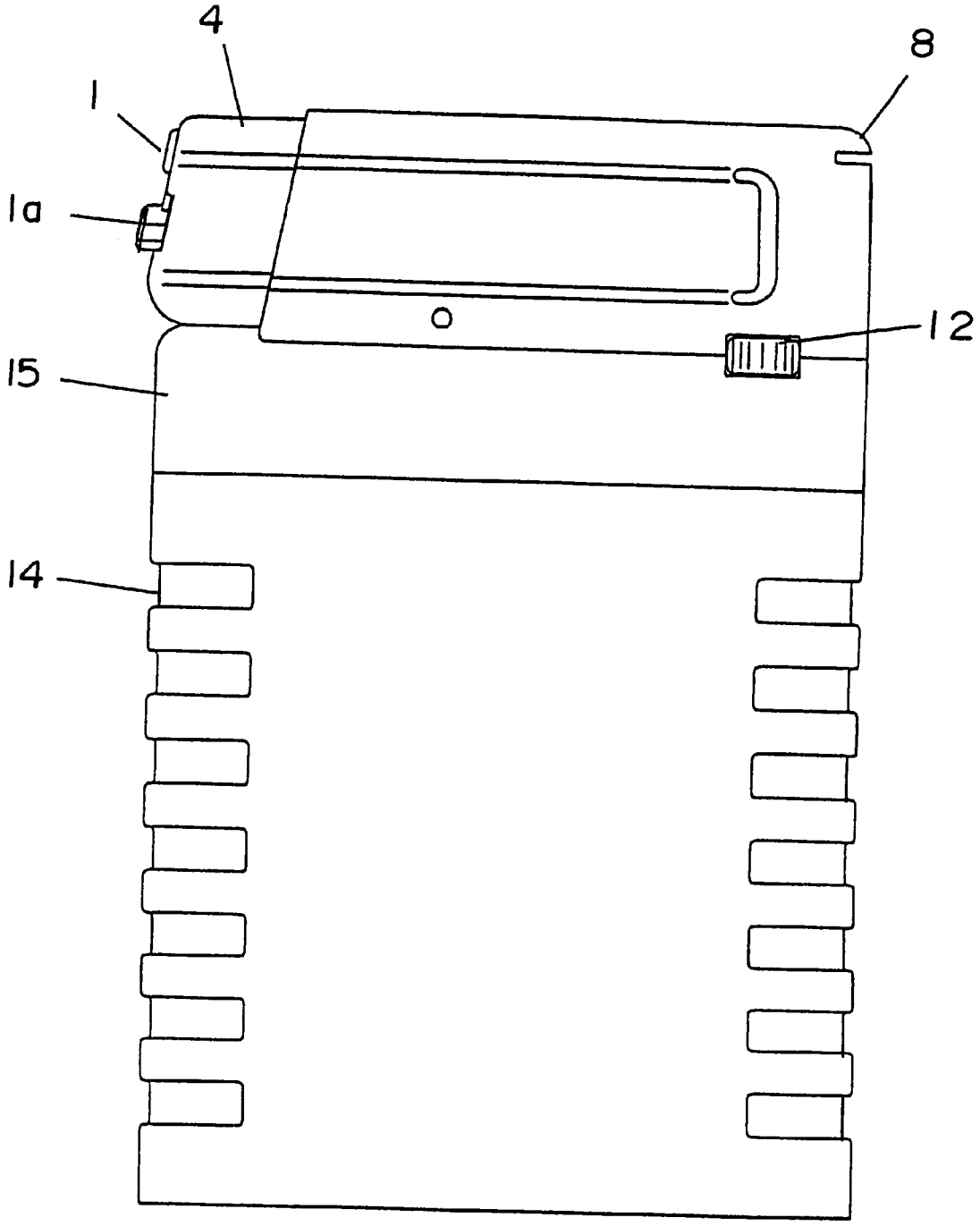
FIG. 1 is a side view of an ultra-thin cigarette lighter in accordance with the present invention.
Figure 2:
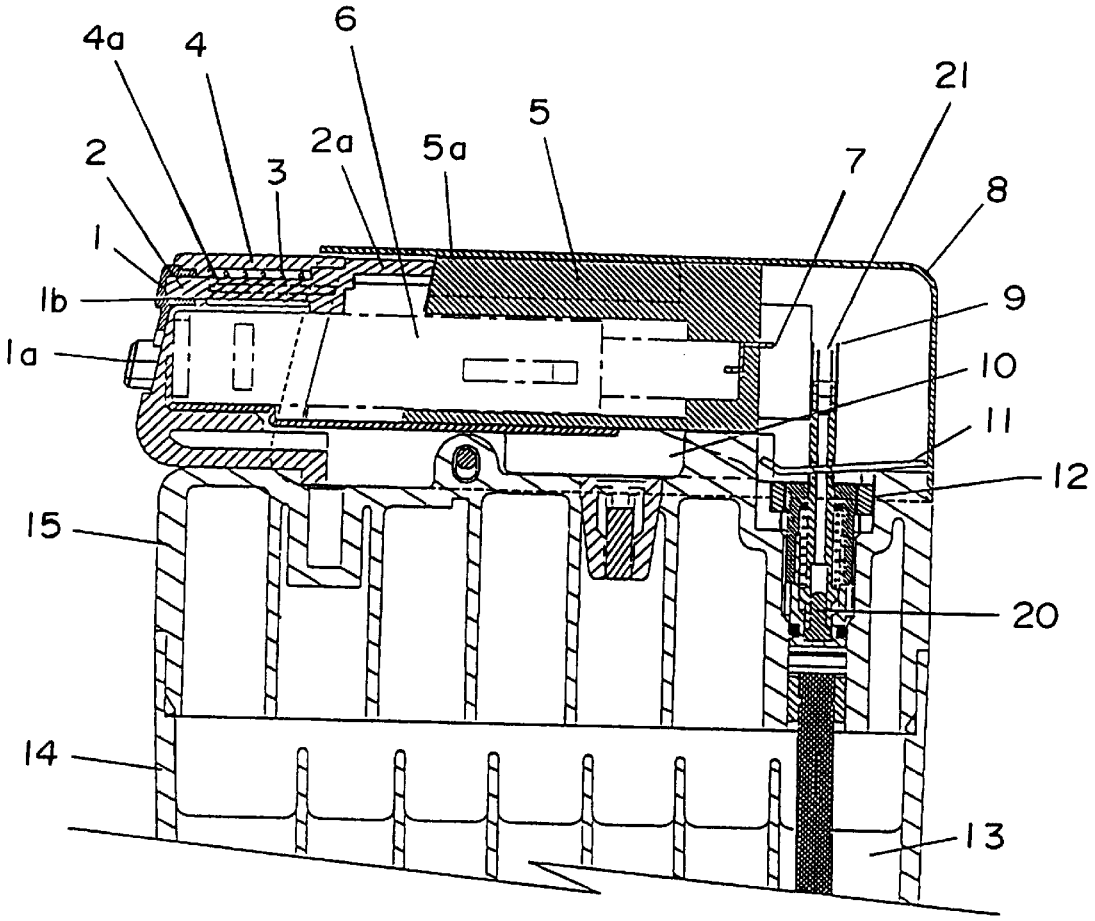
FIG. 2 is a partial vertical section through the cigarette lighter of FIG. 1 with the safety device and lighter in normal, non-operating position.

Mounted in push button 4 is one end of a reciprocating valve actuator 10. The other end of the valve actuator 10 co-operates, when push button 4 is pushed in, with a valve 20. The valve 20 has a substantially U-shaped metal plate 11 which co-operates with the valve actuator 10 to urge the stem of the valve 20 upward, opening the valve 20 and discharging gas through nozzle 21 which is surrounded by ignition spring 9. When closed, valve 20 prevents gas 13 from exiting tank 14.

Figure 3:
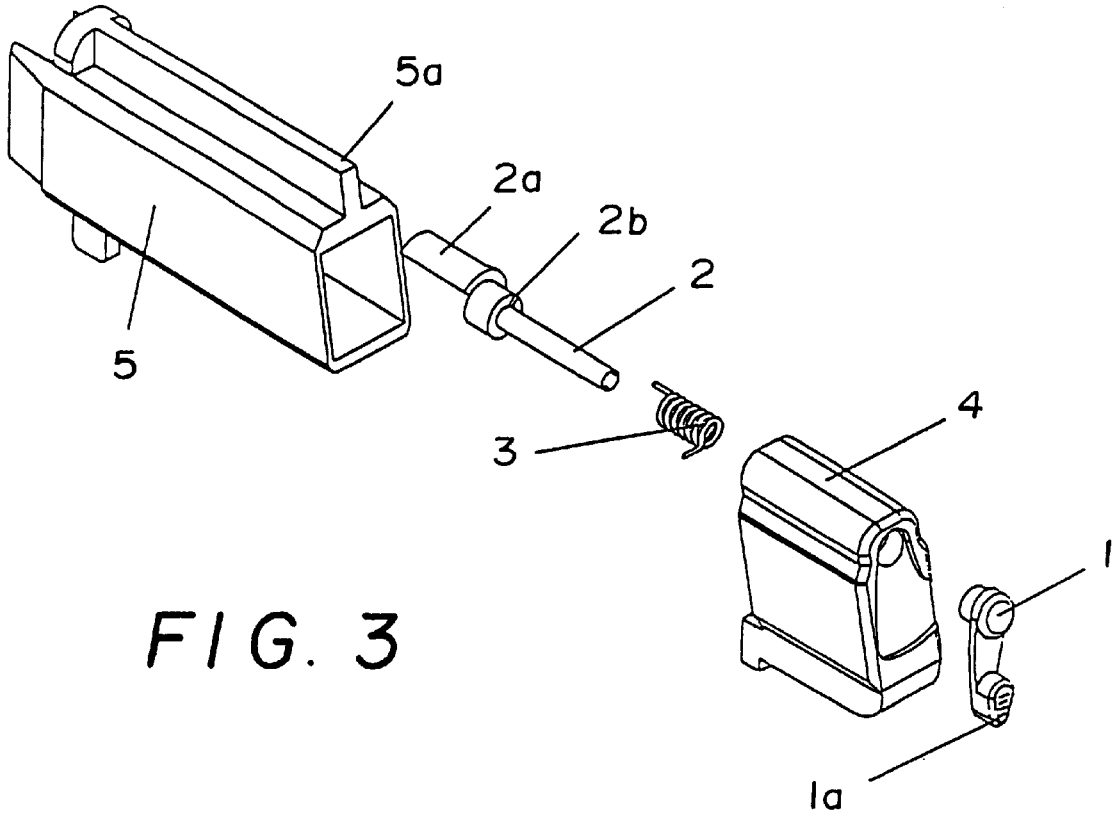
FIG. 3 is an exploded perspective view of part of the ultra-thin cigarette lighter in the normal, non-operating position of FIG. 1.

The configuration of the locking member 2, the operating member 1 and the piezo holder 5 are shown in greater detail in FIG. 3, an exploded view. The locking member 2 is made of resilient or elastic material such as plastic and is provided with a return spring 3 arranged to bear against a collar 2*b* of the locking member 2. Locking member 2 shown in the non-operating position in which extension 2*a* will, in the fully assembled device, engage the end of the upstanding extension 5*a* of the piezo holder 5.

Figure 4:
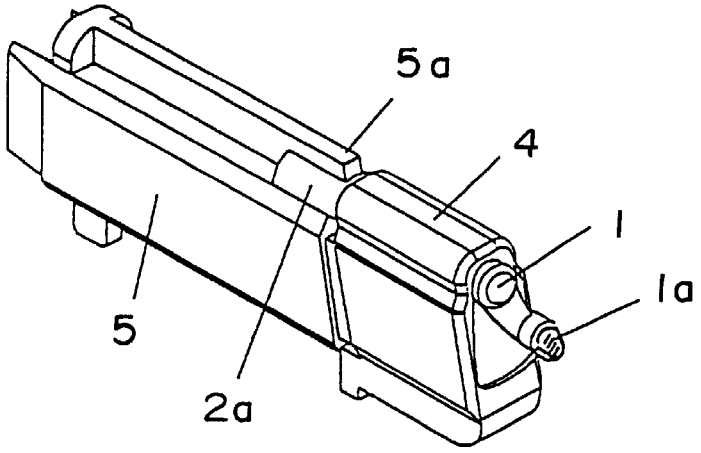
FIG. 4 is a perspective view of that part of the safety device shown in FIG. 3, but not exploded and in operating position.

FIG. 4 shows the operation of the lighter. As the boss 1*a* of the operating member 1 is rotated, extension 2*a* of the locking member 2 is moved out of engagement with the end of the upstanding extension 5*a* of the piezo holder 5 and as the push button 4 is simultaneously pushed into the windshield 8 (not shown), the extension 2*a* moves down the side of upstanding extension 5*a*. This causes the valve actuator 10 to engage the under side of the U-shaped metal plate 11 of valve 20 urging the stem of the valve upwardly to release gas from the tank 14. Piezo unit 6 is simultaneously compressed and emits sparks from the electrode 7. This ignites gas around the ignition spring 9 of nozzle 21 and generates a flame.

Figure 5:
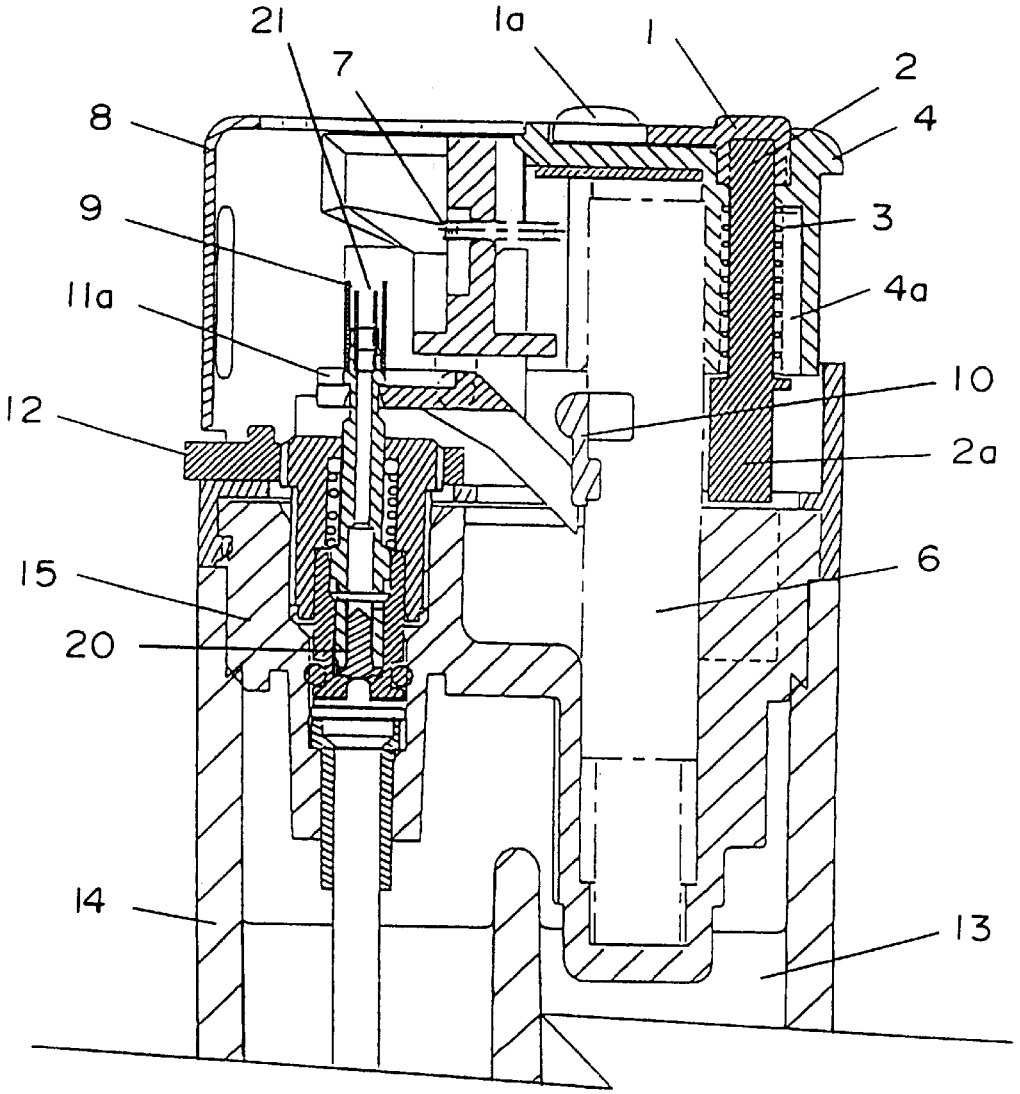
FIG. 5 is a vertical section through an alternative form of the invention embodied in a cigarette lighter of more conventional size with the safety device and lighter in the normal, non-operating position.

As shown in FIG. 5 the safety device can be used in a cigarette lighter of conventional size. Since the components of a conventional cigarette lighter are essentially the same as that of the ultra-thin cigarette lighter described above, it will not be described in detail other than to comment that the U-shaped metal plate 11 is replaced by a lever 11*a*.

A latitude of modification, change and substitute is intended in the foregoing disclosure and accordingly, it is appropriate that the appended claims be constructed broadly and on a manner consistent with the spirit and scope of the invention herein.

What is claimed is:

1. A cigarette lighter comprising:

a tank for a combustible gas under pressure;

a valve which is normally closed to prevent gas from exiting the tank, but which can be opened to allow gas to escape from the tank through a nozzle;

a valve actuator operable to open the valve;

a spark producer operable to produce a spark in the vicinity of the nozzle and cause ignition of gas escaping from the tank when the valve is opened by the valve actuator;

a spark producer holder having an upstanding extension with an end;

a push button operable by engagement of a user's finger to operate the valve actuator, open the value and operate said spark producer, and a movable safety device in the form of an elongated resilient bar provided at one end with a rotatable operating member and at the other end with an extension, said safety device being movable between a normal position in which the safety device prevents operation of the push button by means of the extension engaging the end of the upstanding extension of the spark producer holder, and an operating position to which the safety device can be moved by rotation of the operating member about an axis which is substantially parallel to the length of the safety device, whereby the extension of the safety device is moved out of engagement with the end of the upstanding extension of the spark producer holder simultaneously as the push button is pushed inwards so that the extension moves down the side of the upstanding extension, returning to its normal position after use of the cigarette lighter.

2. A cigarette lighter as claimed in claim 1 wherein the valve includes a substantially U-shaped metal plate having upturned ends to engage with the valve actuator.

3. A cigarette lighter as claimed in claim 2 wherein the valve actuator is an elongated metal bar, one end of which is fixed into the push button and the other end of which is shaped to engage the under sides of the up-turned ends of the metal plate.

4. A cigarette lighter as claimed in claim 1 wherein the spark producer is a piezo unit, one end of which is located in the push button.

5. A cigarette lighter as claimed in claim 4 wherein the piezo unit is provided with an electrode and a piezo body movably located in said spark producer holder.

6. A cigarette lighter as claimed in claim 1 wherein a return spring biases the operating member towards its normal position.

7. A cigarette lighter comprising:

a tank for a combustible gas under pressure;

a valve which is normally closed to prevent gas from existing the tank, but which can be opened to allow gas to escape from the tank through a nozzle;

a valve actuator operable to open the valve;

a spark producer operable to produce a spark in the vicinity of the nozzle and cause ignition of gas escaping from the tank when the valve is opened by the valve actuator;

a spark producer holder having an upstanding extension with an end;

a push button operable by engagement of a user's finger to operate the valve actuator, open the valve and operate said spark producer, and a movable safety device in the form of an elongated resilient bar provided at one end with a rotatable operating member and at the other end with an extension, said safety device being movable between a normal position in which the safety device prevents operation of the push button by means of the extension engaging the end of the upstanding extension of the spark producer holder, and an operating position to which the safety device can be moved by rotation of the operating member, whereby the extension of the safety device is moved out of engagement with the end of the upstanding extension of the spark producer holder simultaneously as the push button is pushed inwards so that the extension moves down the side of the upstanding extension, returning to its normal position after use of the cigarette lighter, wherein said operating member is rotatable about an axis which is substantially parallel to the direction of movement of said push button relative to the spark producer holder.

* * * * *